US007232596B2

(12) United States Patent
Lai

(10) Patent No.: US 7,232,596 B2
(45) Date of Patent: Jun. 19, 2007

(54) REFINED STRUCTURE FOR ARTIFICIAL CHRISTMAS TREE

(76) Inventor: Chung-Ho Lai, 9F-2, No.152, Sec.1, Chung Shiao E. Rd., Taipei (TW)

( * ) Notice: Subject to any disclaimer, the term of this patent is extended or adjusted under 35 U.S.C. 154(b) by 0 days.

(21) Appl. No.: 11/249,523

(22) Filed: Oct. 14, 2005

(65) Prior Publication Data

US 2006/0246236 A1 Nov. 2, 2006

(30) Foreign Application Priority Data

Apr. 30, 2005 (CN) ..... 2005 2 0057760

(51) Int. Cl.
*A47G 33/06* (2006.01)
*A41G 1/00* (2006.01)

(52) U.S. Cl. ..... 428/18; 428/20

(58) Field of Classification Search ..... 428/18, 428/19, 20

See application file for complete search history.

(56) References Cited

U.S. PATENT DOCUMENTS 1,933,495 A * 10/1933 Howard ..... 428/20

* cited by examiner

*Primary Examiner*—Jennifer McNeil
*Assistant Examiner*—Aaron Austin

(57) ABSTRACT

The present invention is related to a technological field of decoration, and more particularly to a structure of an artificial tree, wherein the trunk main body has multiple sets of plugging holes, which are circularly arranged, longitudinally mounted thereon and the end terminals of the branches are plugged in the plugging holes. Because the branches are directly plugged into the plugging holes mounted on the trunk main body, the branch connecting elements and rivets which are served as medium components can be saved so that the structure of the artificial Christmas tree can be simplified, and correspondingly, the production procedure and the cost also can be reduced.

6 Claims, 8 Drawing Sheets

REFINED STRUCTURE FOR ARTIFICIAL CHRISTMAS TREE

BACKGROUND OF THE INVENTION

1. Field of the Invention

The present invention is related to a technological field of decoration, and more particularly to a structure of an artificial Christmas tree.

2. Description of the Prior Art

Because the diplomacy of the country becomes more and more extensive, some western festivals gradually become more and more popular in our daily life, Christmas Day being one of them. In generally, during Christmas, the Christmas tree is absolutely an indispensable decoration. However, because the requirements of real Christmas trees truly consume a large amount of woods and are harmful to forest resources, in recent years, people use artificial Christmas trees instead of the Christmas trees formed by real wood and branches. As can be seen from the current artificial Christmas tree in the market, various types can be found, but it is no more than a combination of a trunk main body and branches. In a common artificial tree, several branch connecting elements are longitudinally sleeved on the trunk main body, multiple plugging holes which are circularly distributed are mounted on the branch connecting elements, and the end terminals of the branches are riveted on the branch connecting elements for fixing the branches. However, a Christmas tree of this structure is connected by connecting the trunk main body with the branches through the branch connecting elements such that the structure thereof is quite complicated and the production procedure and the cost are accordingly increased.

SUMMARY OF THE INVENTION

The object of the present invention is to provide a refined structure of an artificial Christmas tree, which allows the trunk main body and the branches to combine directly for saving the working procedure of riveting and also the branch connecting elements so as to reduce the production procedure and the cost.

For carrying out the above object, the present invention includes a trunk main body and branches, wherein the trunk main body has multiple sets of plugging holes, which are circularly arranged, longitudinally mounted thereon and the end terminals of the branches are plugged in the plugging holes.

Preferably, the end terminals of the branches are mutually stacked and pressed together.

Preferably, the plugging holes can be classified into two types: a "8"-shaped type and a "0"-shaped type, which are mutually staggered in height, and the "8"-shaped plugging hole may have a guiding channel formed at the top thereof. Furthermore, the branch has a shape of "L" and an end portion thereof has a blocking protruding point matched to the guiding channel.

Also, the plugging holes can all have a shaped of "0" and are still staggered in height, and the branch may have a shape of "L" in which a deformed bend is formed at the end portion thereof.

Preferably, the trunk main body is composed of multiple sections by mutually plugging and sleeving two adjacent sections together.

The present invention is effectively advantageous in that: because the branches are directly plugged into the plugging holes, which are mounted on the trunk main body, the branch connecting elements, which are served as the medium components, can be saved so that the structure of the artificial Christmas tree can be simplified, and correspondingly, the production procedure and the cost also can be reduced. Furthermore, since the end terminals of the branches are mutually stacked and pressed, the branches are allowed to support one another so as to achieve an average force distribution.

These features and advantages of the present invention will be fully understood and appreciated from the following detailed description of the accompanying Drawings.

DETAILED DESCRIPTION OF THE PREFERRED EMBODIMENT

The following preferred embodiments according to the present invention are only for illustration and not for limiting the scope of the present invention.

Figure 1:
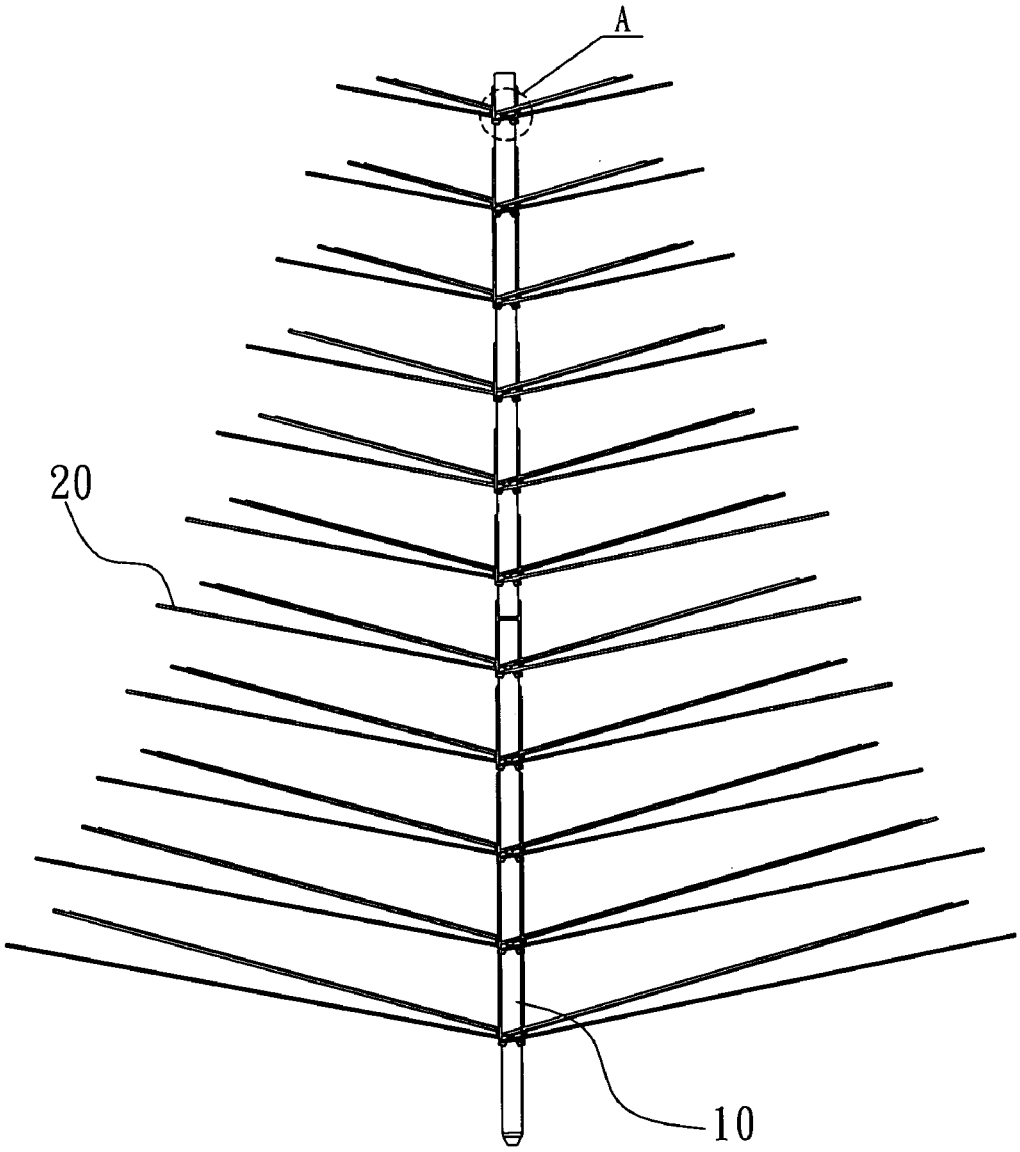
FIG. 1 is a schematic view showing the whole structure of the present invention.
Figure 8:
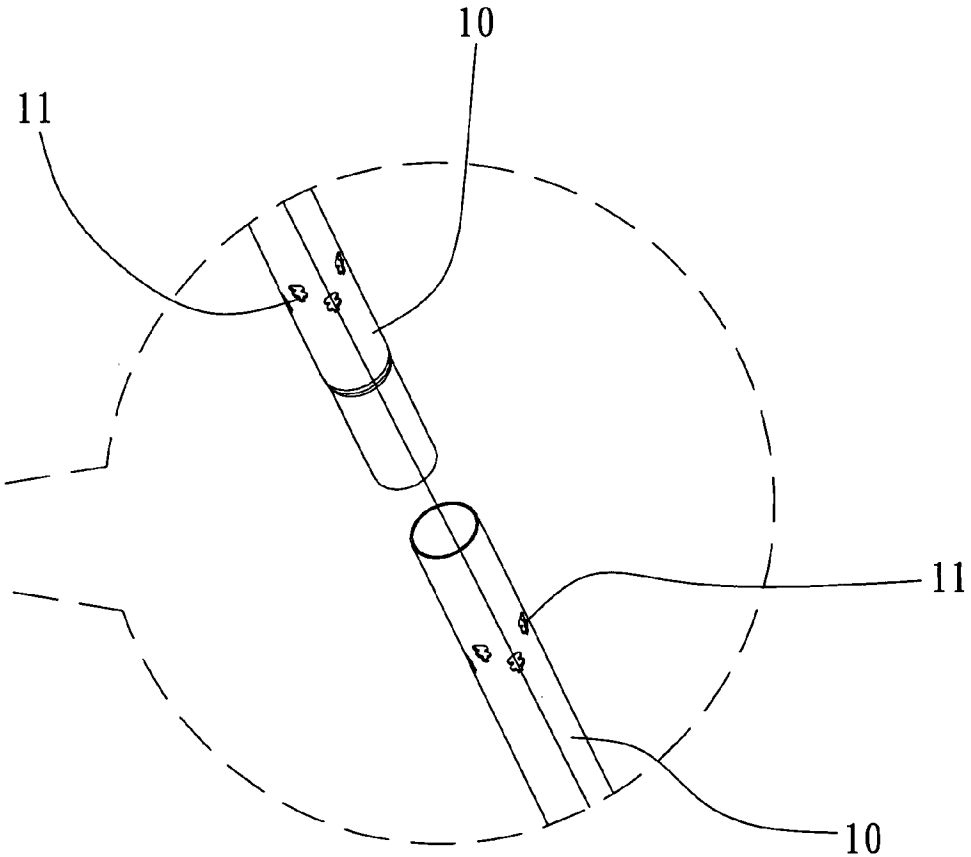
FIG. 8 is a partial magnification drawing of the C position in FIG. 7.
Figure 7:
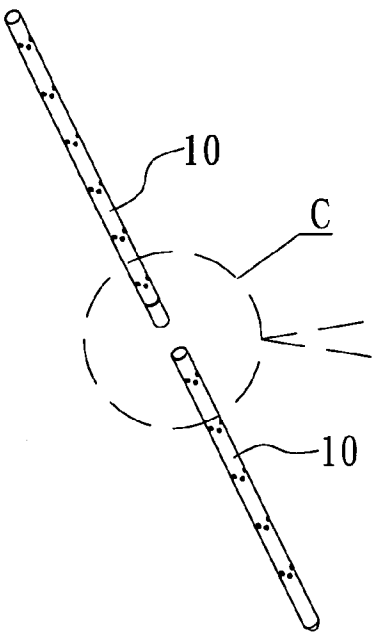
FIG. 7 is a structural schematic view showing a sleeving connection of two sections of trunk main bodies.
Figure 9:
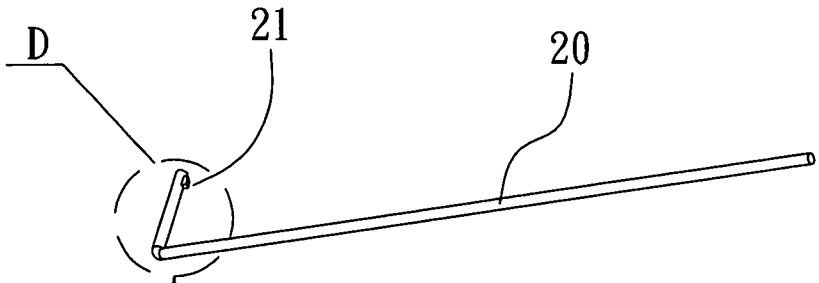
FIG. 9 is a structural schematic view of a branch (having a blocking protruding point located at the end portion)
Figure 10:
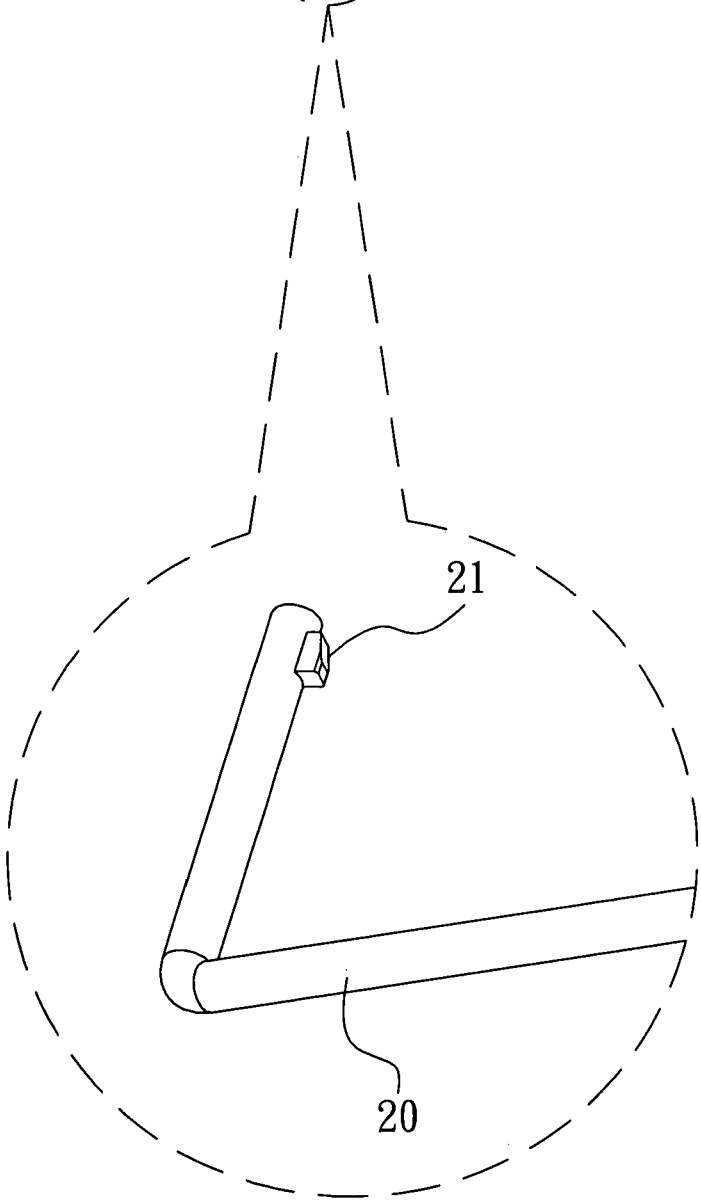
FIG. 10 is a partial magnification drawing of the D position in FIG. 9.

As shown in FIG. 1, the present invention includes a tubular trunk main body 10 and six (of course, can be other numbers) branches 20. According to FIGS. 2, 7 and 8, the trunk main body 10 has multiple sets of plugging holes 11, which are circularly arranged, longitudinally mounted thereon, wherein the plugging holes 11 can be classified into two types: a "8"-shaped type and a "0"-shaped type, the plugging holes 11 of these two types being mutually staggered in height and at the top of the "8"-shaped plugging hole 11, a guiding channel being formed. Moreover, for convenient collection and transportation, the trunk main body 10 is composed of multiple sections by mutually plugging and sleeving two adjacent sections together. Furthermore, as shown in FIGS. 9 & 10, the branch has a shape of "L" in which a blocking protruding point 21 which is matched to the guiding channel 12 is formed at the end portion thereof.

Figure 2:
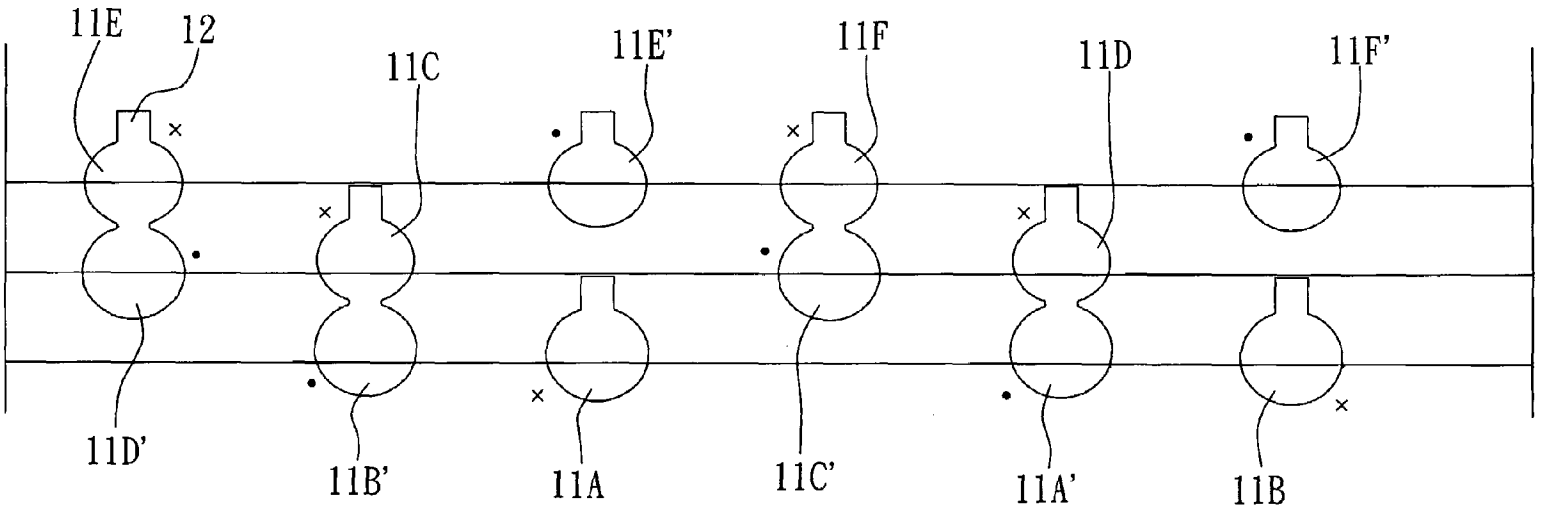
FIG. 2 is an unfolded drawing showing a set of plugging holes mounted on a trunk main body.

When assembling, as shown in FIG. 2 (in which "." represents penetrating out of the paper and "x" represents passing into the paper), the end portion of a first branch 20 is plugged into a plugging hole 11A and penetrated out from a plugging hole 11A', the end portion of a second branch 20 is plugged into a plugging hole 11B and penetrated out from a plugging hole 11B', the end portion of a third branch 20 is plugged into a plugging hole 11C and penetrated out from a plugging hole 11C', the end portion of a fourth branch 20 is plugged into a plugging hole 11D and penetrated out from a plugging hole 11D', the end portion of a fifth branch 20 is plugged into a plugging hole 11E and penetrated out from a plugging hole 11E', and the end portion of a sixth branch 20F is plugged into a plugging hole 11F and penetrated out from a plugging hole 11F'.

Figure 3:
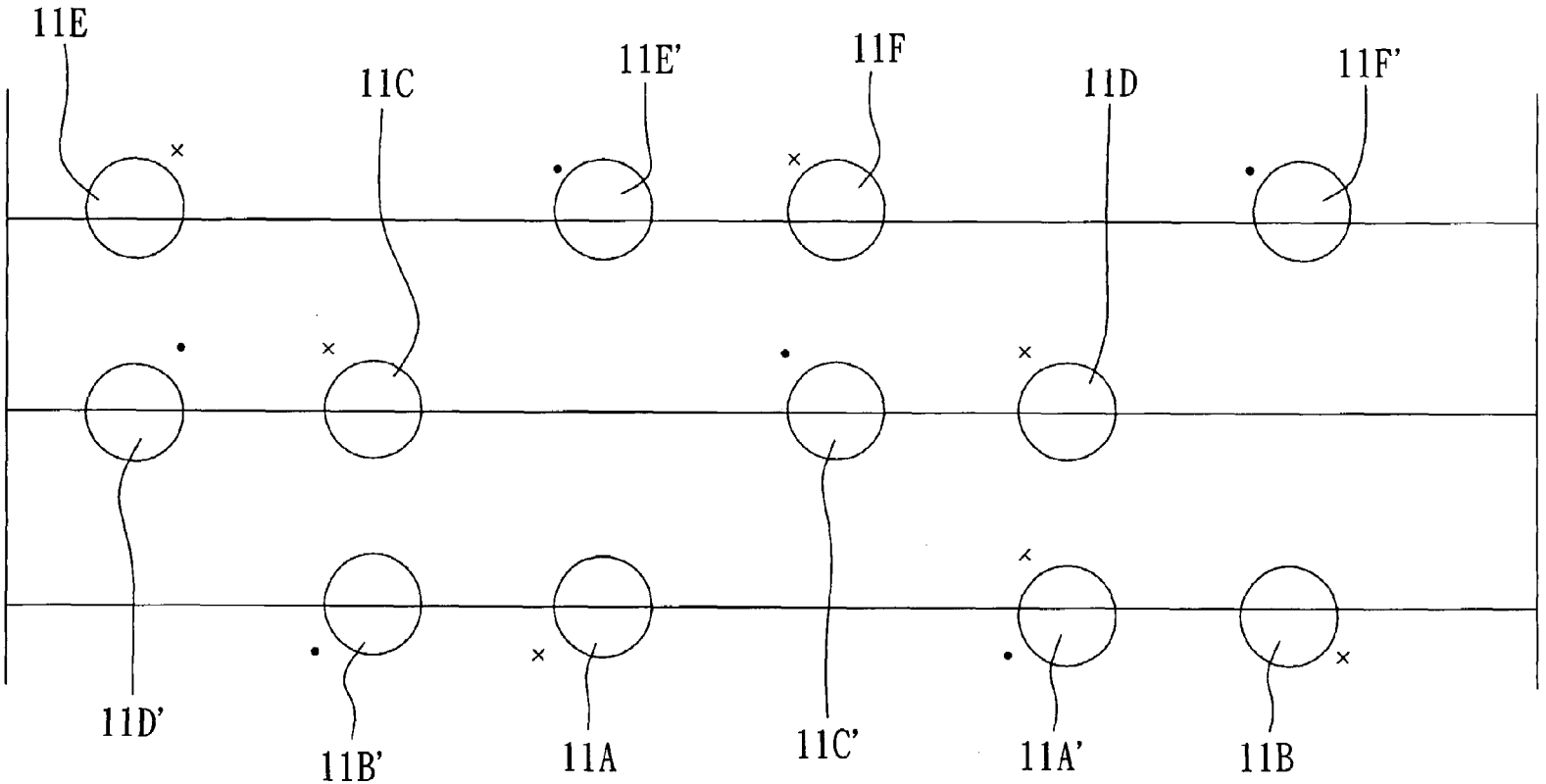
FIG. 3 is an unfolded drawing showing a set of plugging holes mounted on a trunk main body.
Figure 11:
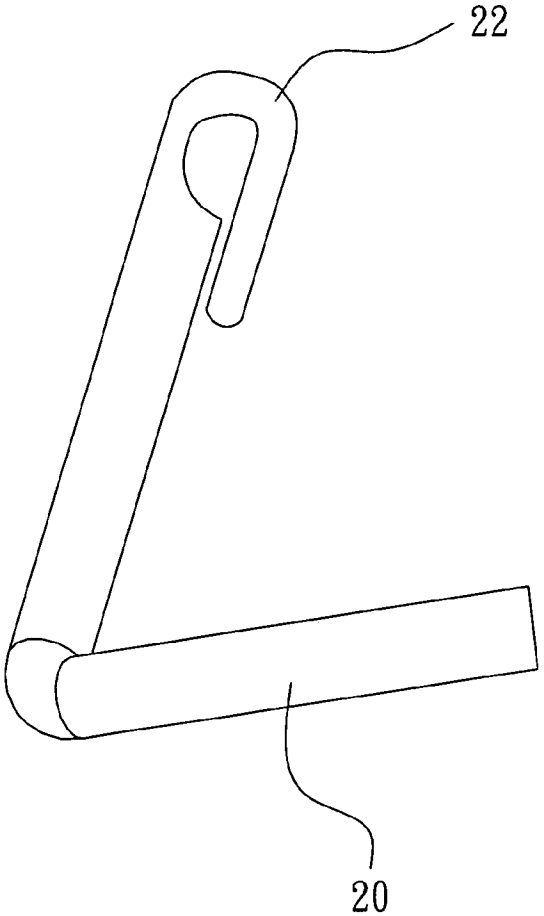
FIG. 11 is another structural schematic view showing the branch (having a deformed bend at the end portion).

Certainly, the plugging hole 11 also can have other shapes. For example, as shown in FIG. 3, the plugging holes 11 can all have a shape of "0". In this case, the assembling of the branches 20 is identical to the description above except for the end terminal of the branch 20 is formed to have a deformed bend 22 (as shown in FIG. 11) for preventing from receding after penetrating out from the plugging hole 11.

Figure 4:
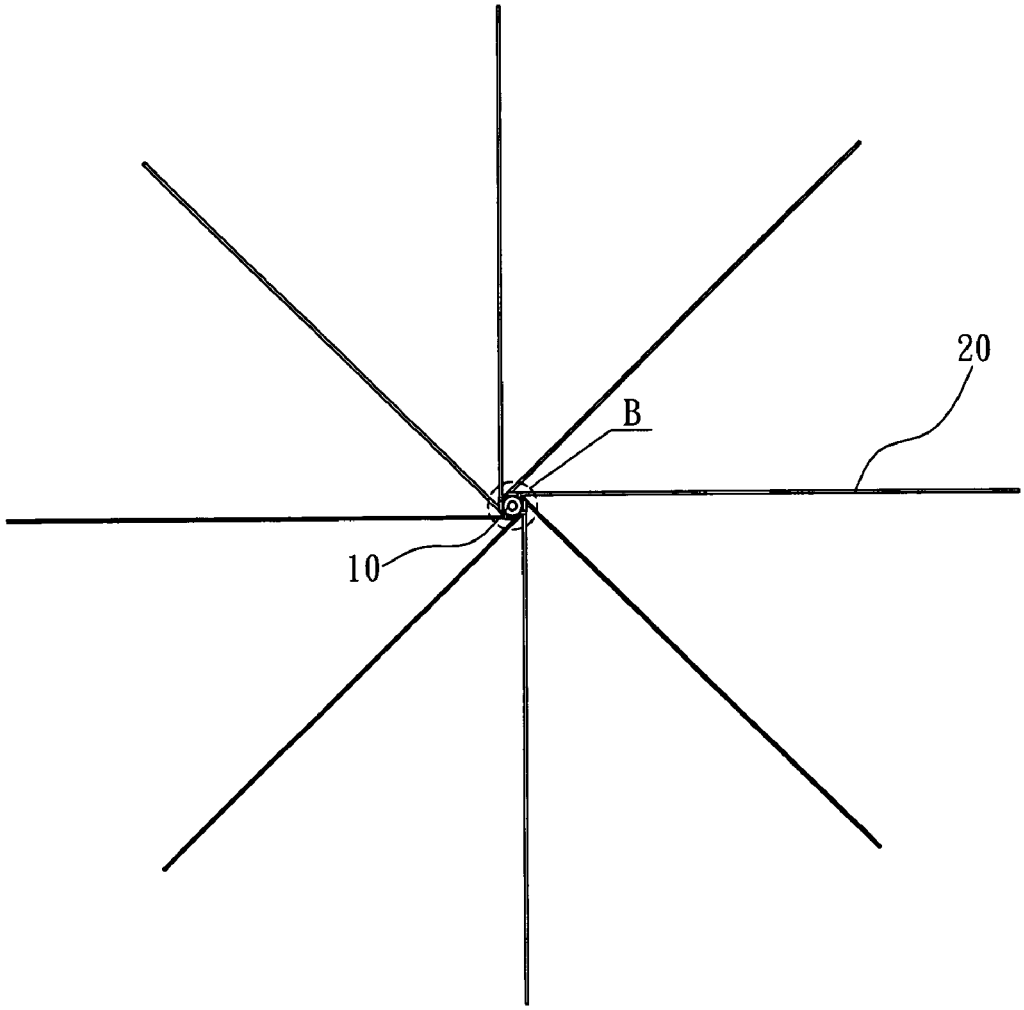
FIG. 4 is a top view along the A position in FIG. 1.
Figure 5:
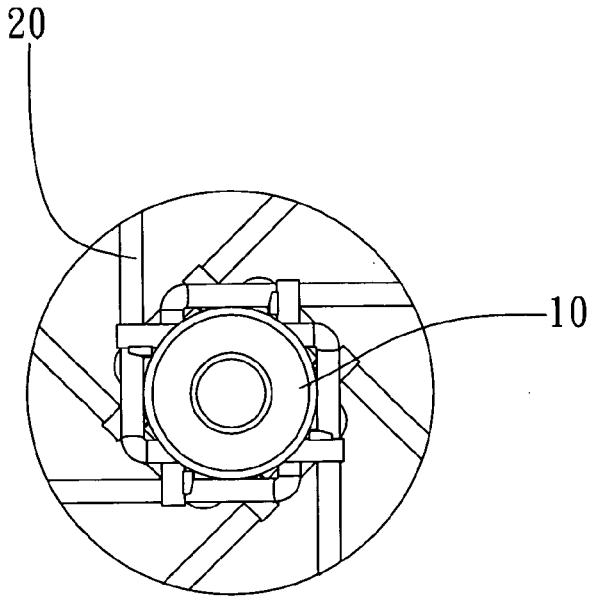
FIG. 5 is a partial magnification drawing of the B position in FIG. 4.
Figure 6:
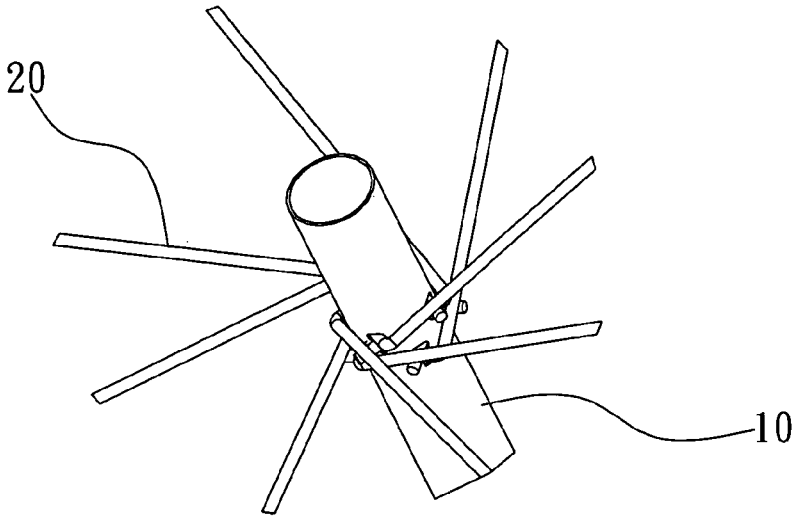
FIG. 6 is a 3D schematic view showing the combination of the trunk main body and the branches.

As shown in FIGS. 4 to 6, after all the branches 20 are correspondingly plugged into the plugging holes 11, an appropriate rotation of the branches 20 is executed so that they can be mutually stacked and pressed. On one hand, this execution can avoid the branches 20 from departing from the plugging holes 11, and on the other hand, the execution also allows the branches to support one another so as to achieve an average force distribution.

It should be noted that: the artificial Christmas tree according to the present invention also has the function of auto-folding as compared to the conventional artificial Christmas tree which adopts the branch connecting elements to connect the trunk main body and the branches. FIG. 1 shows the open state of the Christmas tree. When the Christmas tree is upside down, the branches 20 can automatically be drawn in for convenient packaging and transportation.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A refined structure of an artificial Christmas tree comprising:

a trunk main body including multiple sets of plugging holes longitudinally formed thereon each set of plugging holes including at least two pairs of holes circularly arranged and;

at least two L-shaped branches, each with one shorter end plugged in and passing through corresponding one pair of holes so that two branches are mutually stacked and pressed together.

2. The structure according to claim 1, wherein said plugging holes include "8"-shaped and "0"-shaped holes mutually staggered in height, and each "8"-shaped or "0"-shaped hole has a guiding channel and each branch has a blocking protruding point formed on the shorter end to match with said guiding channel so that the branch is prevented from receding after penetrating out from the plugging hole and stacked with another branch.

3. The structure according to claim 1, wherein said plugging holes all have a shape of "0" and are staggered in height, and each branch has a deformed bend formed at the shorter end for preventing each branch from receding after penetrating out from the plugging hole.

4. The structure according to claim 1, wherein said trunk main body is composed of multiple sections by mutually plugging and sleeving two adjacent sections together.

5. The structure according to claim 2, wherein said trunk main body is composed of multiple sections by mutually plugging and sleeving two adjacent sections together.

6. The structure according to claim 3, wherein said trunk main body is composed of multiple sections by mutually plugging and sleeving two adjacent sections together.

* * * * *